United States Patent [19]

Bruckner

[11] 4,407,626

[45] Oct. 4, 1983

[54] GRIPPING DEVICE

[76] Inventor: Peter J. Bruckner, Box 187, Nakusp, British Columbia, Canada

[21] Appl. No.: 229,868

[22] Filed: Jan. 30, 1981

[51] Int. Cl.[3] ..... E02F 3/28

[52] U.S. Cl. ..... 414/740; 414/722; 414/694; 294/104; 37/117.5

[58] Field of Search ..... 414/685, 687, 607, 725, 414/726, 722, 740, 731, 694; 172/247, 252; 37/117.5, 103, DIG. 3; 294/103 R, 104, 106, 88

[56] References Cited

U.S. PATENT DOCUMENTS

| | | | |
|---|---|---|---|
| 2,044,624 | 6/1936 | Morgan | 414/694 |
| 3,275,172 | 9/1966 | Smith | 414/694 |
| 3,353,285 | 11/1967 | Murray | 414/694 X |
| 3,802,731 | 4/1974 | LaBounty | 294/88 |
| 3,807,589 | 4/1974 | Shovick | 37/117.5 X |

FOREIGN PATENT DOCUMENTS

| | | | |
|---|---|---|---|
| 924751 | 5/1963 | United Kingdom | 37/117.5 |
| 377478 | 4/1973 | U.S.S.R. | 414/722 |
| 624993 | 9/1978 | U.S.S.R. | 37/117.5 |
| 713948 | 2/1980 | U.S.S.R. | 414/731 |

*Primary Examiner*—Robert J. Spar
*Assistant Examiner*—Terrance L. Siemens
*Attorney, Agent, or Firm*—Beehler, Pavitt, Siegemund, Jagger & Martella

[57] ABSTRACT

A gripping device to be attached to a boom of a backhoe. The device has a rigid beam to attach to the boom. A gripping member is formed on the rigid beam and positioned to be opposed to the reciprocable member of the backhoe when the gripping device is in position on the boom. There is an anchor point on the rigid beam. A support arm extends from the anchor point to attach to the boom. The device provides a solid removable attachment to the boom, against which an object can be gripped by movement of the reciprocable member of the backhoe.

1 Claim, 3 Drawing Figures

GRIPPING DEVICE

FIELD OF THE INVENTION

This invention relates to a gripping device useful with a backhoe and is particularly useful in logging.

DESCRIPTION OF THE PRIOR ART

In logging the removal of stumps can provide a problem. Generally speaking the stumps are simply forced from the ground using hydraulic machinery. A number of devices exist for attachment to the boom of hydraulic machinery to facilitate removal of the stumps. However, in general these devices are either too complicated or not sufficiently rigid. In particular devices incorporating hydraulic cylinders are not generally appropriate as the devices are subjected to hard use and the necessary connections to the hydraulic cylinders can easily be damaged. Furthermore, it is essential that the device provide a rigid base against which a stump can be gripped to facilitate the removal of the stump. Clearly considerable forces can be required to remove a stump.

Examples of the prior art include United States Pat. Nos. 3,832,999 to Asbury; 3,854,608 to Arnold; 3,613,922 to Clark; 3,273,729 to Holopainen; 3,156,368 to Schutte; and 2,903,146 to Mely. Although the above prior art generally indicates devices for attaching to a backhoe or the like to facilitate the removal of stumps a number of disadvantages have militated against their common use in the art. Generally speaking they are not sufficiently rigid and, indeed, in certain cases deliberately feature flexible links. Others have movable arms that require hydraulic cylinders to operate them.

SUMMARY OF THE INVENTION

The present invention seeks to provide a device that can be mounted on the boom of a backhoe and does not require its own hydraulic cylinder or the like to operate.

Accordingly, in a first aspect, the present invention is a gripping device adapted to be attached to the boom of a backhoe having a reciprocable member at an end of the boom, the device comprising a rigid beam adapted to be attached to the boom; gripping means formed on the rigid beam and positioned to be opposed to the reciprocable member of the backhoe when the gripping device is in position on the boom; an anchor point on the rigid beam; a support arm adapted to extend from the anchor point to attach to the boom whereby the device provides a solid, removable attachment to the boom, against which an object can be gripped by movement of the reciprocable member of the backhoe.

BRIEF DESCRIPTION OF THE DRAWINGS

Aspects of the invention are illustrated in the accompanying drawings in which.

DESCRIPTION OF THE PREFERRED EMBODIMENTS

Figure 1:
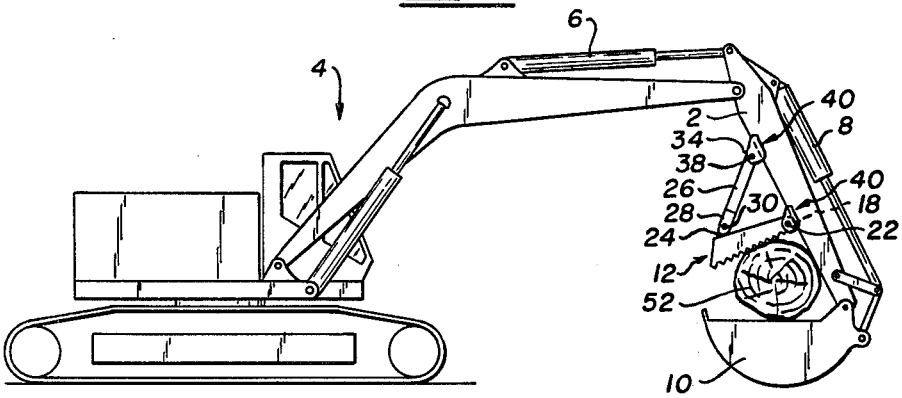
FIG. 1 is a general view of a backhoe fitted with a device according to the present invention.

Referring to the drawings they illustrate a gripping device adapted to be attached to a boom 2 of a backhoe generally indicated at 4. The backhoe 4 and the boom 2 are entirely conventional. For example they feature hydraulic cylinders 6 used to move the boom and a further hydraulic cylinder 8 used to reciprocate a bucket 10 attached to the end of the boom.

Figure 2:
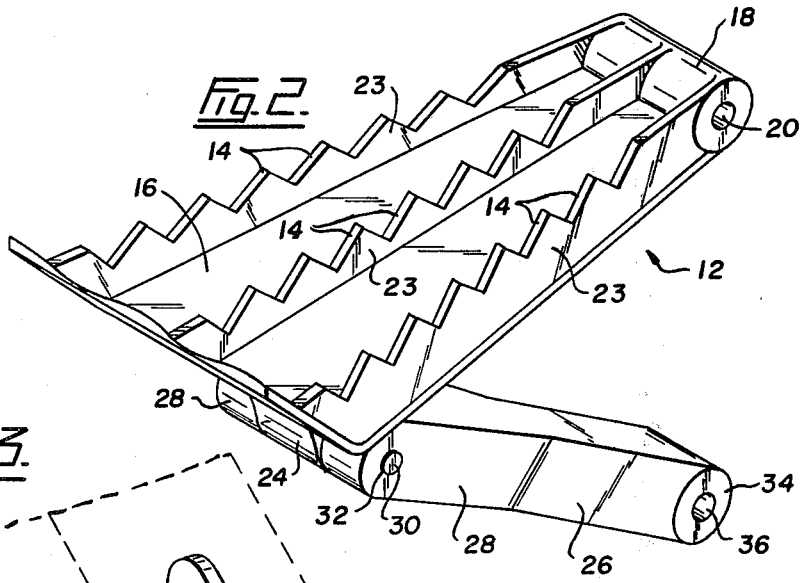
FIG. 2 is a perspective view, generally from the underneath, of a device according to the invention.

The device according to the present invention comprises a rigid beam 12 adapted to be attached to the boom 2. There are teeth 14 formed on the rigid beam. In the preferred embodiment illustrated in FIG. 2, the beam 12 comprises a rigid back plate 16 welded to a boss 18 having a central opening 20 to make up a first connection for the beam 12. The opening 20 receives a rod 22 that also engages holding brackets attached to the boom 2 of the backhoe 4. Toothed members 23 are welded to the back plate 16. There is a second connection on the back plate 16 at a position remote from the boss 18. The second connection may comprise, as shown in FIG. 2, an upstanding lug 24 again having a central opening (not shown). There is a support arm 26 having spaced limbs 28 at one of its ends to extend around the lug 24. A pin 30 extends through holes 32 in the spaced limbs 28 and through the aligned hole in the lug 24. At the other end of the support arm 26 there is a further connection comprising a boss 34 formed with a central opening 36 to engage a second rod 38 that also attaches to holding brackets on the boom 2 at a position more remote from the bucket 10 than the first rod 22.

The arrangement is such that a triangle is provided by the rigid beam 14, the support arm 26 and the boom 2 provides an extremely rigid mounting for the teeth 14 that are opposed to the bucket 10 of the backhoe 4.

Figure 3:
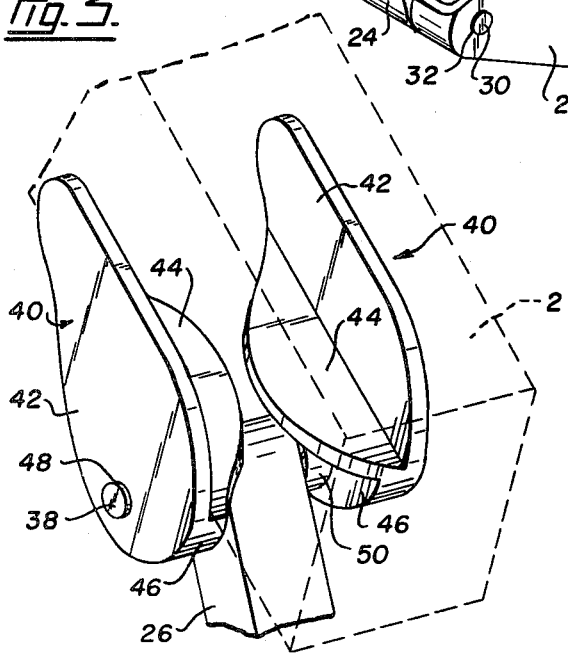
FIG. 3 is a detail of FIG. 1.

The brackets whereby the support arm 26 and the beam 12 are attached to the boom 2 are shown in FIG. 3. Only one pair of such brackets is shown but both pairs of brackets, the upper and the lower as shown in FIG. 1 on the boom 2, are the same.

The brackets comprise two members 40 each comprising a side plate 42 to be attached to, for example by welding, at the side of boom 2. There is an underplate 44 attached to the underside of the boom 2, again, for example, by welding. Extensions 46 of the side plates 42 extend downwardly and are formed with aligned holes 48 to engage, respectively, the pin 38 (as shown) or the pin 22. Support arm 26, as shown in FIG. 3, then engages on the pin 38. Distance pieces 50 (only one of which is shown) may be positioned between the extensions 46 and the arm 26. The use of the distance pieces 50 permits the attachment of varying sizes of support arm 26 and beam 12 without undue play.

The use of the brackets provides a simple means of anchoring the beam 12 and the support arm 26 to the boom 2. Further the attachment is such that when the beam 12 is not required support arm 26 may be removed by removing its attaching pin 38 and beam 12 then pivoted upwardly about pin 22 and attached to the upper brackets by reinserting pin 38. In this position the beam 12 is out of the way, that is it does not interfere with the normal operation of the backhoe nor is there prospect of it being damaged.

In use the device according to the present invention is positioned around a stump 52 with the teeth 14 of the rigid beam 12 in contact with the stump 52. The hydraulic cylinder 8 is operated to move the bucket 10 to force the stump 52 against the teeth 14. The grip is so powerful that the stump 52 may be moved from the ground.

The device according to the present invention is relatively cheap to make, is robust and simple in construction.

I claim:

1. A device to be mounted to a boom of a back hoe, the boom having a bucket and first and second spaced rods, the first rod closer to the bucket than the second rod the device comprising:

a first connection to pivotally engage the first rod;

a back plate attached to the first connection;

rows of teeth extending longitudinally of the back plate to extend towards the bucket of the back hoe;

a detachable second connection on the back plate, remote from the first connection;

a support arm detachably attached to the second connection at one of its ends and extending towards the boom;

the distance between the first and second connections being the same as the distance between the first and second rods;

a detachable third connection to engage the second rod attached to the support arm at the other of its ends, whereby the device may be attached to the boom of a back hoe to provide a rigidly mounted gripping surface against which an object can be forced by movement of the bucket and thus held, and whereby the second and third connections may be detached to remove the support arm, and the back plate pivoted to a rest position, generally adjacent and parallel to the boom, and secured in that position by attaching the second connection on the back plate to the second rod.

* * * * *